US008464626B2

(12) United States Patent
Adams et al.

(10) Patent No.: US 8,464,626 B2
(45) **Date of Patent: *Jun. 18, 2013**

(54) MULTI-LAYER METAL MATRIX COMPOSITE ARMOR WITH EDGE PROTECTION

(75) Inventors: Richard Adams, Bolton, MA (US); Renee MacPherson, Attleboro, MA (US); Jim Sorensen, Eagan, MN (US)

(73) Assignee: CPS Technologies Corp., Norton, MA (US)

( * ) Notice: Subject to any disclaimer, the term of this patent is extended or adjusted under 35 U.S.C. 154(b) by 723 days.

This patent is subject to a terminal disclaimer.

(21) Appl. No.: 12/592,233

(22) Filed: Nov. 20, 2009

(65) Prior Publication Data

US 2012/0186427 A1 Jul. 26, 2012

(51) Int. Cl.
*F41H 5/04* (2006.01)

(52) U.S. Cl.
USPC ..... 89/36.02; 89/907; 89/910

(58) Field of Classification Search
USPC ..... 89/36.02; 428/911
See application file for complete search history.

(56) References Cited

U.S. PATENT DOCUMENTS

| | | | | |
|---|---|---|---|---|
| 34,539 | A * | 2/1862 | Warden | 114/12 |
| 3,633,520 | A | 1/1972 | Stiglich | |
| 6,895,851 | B1 | 5/2005 | Adams et al. | |
| 6,955,112 | B1 * | 10/2005 | Adams et al. | 89/36.02 |
| 7,216,576 | B2 * | 5/2007 | Henry et al. | 89/36.02 |
| 8,132,493 | B1 * | 3/2012 | Adams | 89/36.02 |
| 2009/0090236 | A1 * | 4/2009 | Misencik et al. | 89/36.02 |
| 2009/0114083 | A1 * | 5/2009 | Moore et al. | 89/36.02 |
| 2010/0071537 | A1 * | 3/2010 | Weber et al. | 89/36.02 |
| 2012/0180974 | A1 * | 7/2012 | Adams | 164/69.1 |

OTHER PUBLICATIONS

U.S. Appl. No. 12/220,147, filed Jul. 22, 2008, Adams et al.
U.S. Appl. No. 11/713,186, filed Mar. 2, 2007, Adams et al.

* cited by examiner

*Primary Examiner* — Bret Hayes

(57) ABSTRACT

The armor tile system embodying the principles of the present invention comprises one or more hybrid tiles which can be connected together to cover a protected structure. Various arrays of material layers may be utilized (1×1, 2×2, 4×4, 2×8, etc) within a hybrid tile system and multiple hybrid tiles may be mounted on the area to be protected. Each hybrid tile comprises one or more material layers stacked within a single metal matrix casting. Each material layer within a hybrid tile includes at least one reinforcement insert arranged along a common surface. The reinforcement inserts comprise material types suitable for containment, structural support, and projectile deflection and destruction. The armor tile system of the present invention is created utilizing a molten metal infiltration process. In the preferred embodiment, the reinforcement inserts are arranged along a common surface within each material layer and further positioned within the mold cavity to create a controlled inner seam between adjacent reinforcement inserts to keep the reinforcement inserts from shifting during metal infiltration. The outer periphery of the material layer(s) and the mold cavity inside periphery has a space defining an outer seam. Both the outer and inner seams may further contain a reinforcement material to enhance the effectiveness of the armor system if desired. The mold cavity is infiltrated with liquid metal which solidifies within the materials open porosity thereby binding the layers together to create a coherent integral structure.

42 Claims, 24 Drawing Sheets

MULTI-LAYER METAL MATRIX COMPOSITE ARMOR WITH EDGE PROTECTION

FIELD OF THE INVENTION

This invention relates to lightweight armor systems in general and more specifically to a metal encapsulated, hybrid tile system utilizing edge protected material layers of mixed material types.

BACKGROUND OF THE INVENTION

Many different kinds of lightweight armor systems are known and are currently being used in a wide range of applications, including, for example, aircraft, light armored vehicles, and body armor systems, wherein it is desirable to provide protection against armor piercing, explosive and chemical weapons. While early lightweight armor systems for such threats tended to rely on a single layer of a hard and brittle material, such as a ceramic material, it was soon realized that the effectiveness of the armor system could be improved considerably if the ceramic material were affixed to or "backed up" with an energy absorbing material, such as high strength Kevlar fibers. The presence of an energy absorbing backup layer functions to catch the fragments of an incoming projectile but without significantly reducing the spallation of the ceramic caused by impact of the projectile.

Testing has demonstrated that such multi-layer armor systems tend to stop projectiles at higher velocities than do the ceramic materials when utilized without the backup layer. While such multi-layer armoring systems are being used with some degree of success, they are not without their problems. For example, difficulties are often encountered in creating a multi-hit capability armor with multi-layered material structure having both sufficient mechanical strength and ballistic shock resistance as well as sufficient bond strength at the layer interfaces.

Partly in an effort to solve the foregoing problems, armor systems have been developed in which a "graded" ceramic material having a gradually increasing dynamic tensile strength and energy absorbing capacity is sandwiched between the impact layer and the backup layer. An example of such an armor system is disclosed in U.S. Pat. No. 3,633,520 issued to Stiglich and entitled "Gradient Armor System".

The armor system disclosed in the foregoing patent comprises a ceramic impact layer that is backed by an energy absorbing ceramic matrix having a gradient of fine metallic particles dispersed therein in an amount from about 0% commencing at the front or impact surface of the armor system to about 0.5 to 50% by volume at the backup material.

Despite these advances, the need remains for an improved, more optimized lightweight composite armor which has the attributes of rigidity, strength, low density, impact resistance, and ease and favorable cost of manufacturing. As such, a need has developed for an encapsulated ceramic armor material that optimizes ballistic performance and may be manufactured in a repeatable, predictable way.

SUMMARY OF THE INVENTION

The armor tile system embodying the principles of the present invention comprises one or more hybrid tiles which can be connected together to cover a protected structure. Various arrays of material layers may be utilized (1×1, 2×2, 4×4, 2×8, etc) within a hybrid tile system and multiple hybrid tiles may be mounted on the area to be protected.

Each hybrid tile comprises one or more material layers stacked within a single metal matrix casting. Each material layer within a hybrid tile includes at least one reinforcement insert arranged along a common surface. The reinforcement inserts comprise material types suitable for containment, structural support, and projectile deflection and destruction. In one embodiment, the hybrid tile can include cast-in integrated energy absorbing post structures extending outward from the hybrid tile. In this embodiment, the hybrid tile can be bonded to an aluminum backing plate via extending post structures by methods known in the art such as welding, adhesive bonding, or mechanical swaging. In another embodiment, the hybrid tile does not include the energy absorbing post structures.

The armor tile system of the present invention is created utilizing a molten metal infiltration process. For the embodiment comprising post structures, a mold cavity comprising elongated holes machined into its base is provided. If no post structures are desired the mold cavity would comprise a solid base. Next, one or more material layers are placed within the mold cavity. In the preferred embodiment, the reinforcement inserts are arranged along a common surface within each material layer and further positioned within the mold cavity to create a controlled inner seam between adjacent reinforcement inserts to keep the reinforcement inserts from shifting during metal infiltration.

A mold typically contains one or more stacked material layers, each layer comprising reinforcement inserts which may include various geometries of material types, suitable for containment, structural support, and projectile deflection. The outer periphery of the material layer(s) and the mold cavity inside periphery has a space defining an outer seam. Both the outer and inner seams may further contain a reinforcement material to enhance the effectiveness of the armor system if desired.

The mold cavity is infiltrated with liquid metal which solidifies within the materials open porosity thereby binding the layers together to create a coherent integral structure. The reinforcement inserts of dense material types can be selected according to their denseness and fraction of void volume at the material surface that are to be infiltrated with liquid metal. The composition of different layers and layer material types allows the designer to vary thermal expansion coefficients throughout the structure to create varying stress states for increased effectiveness of the armor system. The selection of different material types may also be based on strength, toughness, and weight attributes of the individual material types desirable for projectile impact protection.

To improve the multi-material armor's ability to absorb energy while decreasing the weight of the hybrid tile armor system, reinforcement material containing a fraction of high volume bubbles with interior voids can be utilized. To improve the multi-material armor's structural integrity and to prevent delamination of the armor structure reinforcement material containing three dimensional (3-D) sintered or woven wire mesh is integrated into hybrid tile armor system to anchor the metal infiltrant to the mesh thereby adding structural stability to the armor structure. Furthermore, to improve the hybrid tile systems ability to deflect and initiate fracture to an incoming projectile angular faceted hard particles can be incorporated in the material layer at the tile systems strikeface.

In the embodiment comprising energy absorbing post structures, the elongated holes in the mold cavity base are filled with liquid metal that once solidified then forms integrated cast-in post structures. These posts may be metal rich, contain a hollow microsphere material or contain other material types suitable for energy absorption and attachment of the composite structure to a backing plate.

The mold chamber is fabricated to create the final shape or closely approximate that desired of the final product. The hybrid armor tile is next demolded and comprises a hybrid structure of metal matrix composite material layers with an encapsulating aluminum rich skin and/or metal matrix composite (MMC) enveloping structure. Integrated cast in metal rich post structures can be provided for both 1.) energy absorption and 2.) attachment of the composite structure to a backing plate. The length, diameter, draft angle and spacing of the posts are variable to meet a desired ballistic threat and blast over-pressure.

A fraction of the posts may be used to attach the composite structure to the backing plate, and may be recessed within the backing plate or affixed to the surface of the backing plate. The other fraction of posts being shorter and with post ends either contacting the backing plate, or raised above the backing plate. The attachment posts have a length to allow a separation between the backing plate and the hybrid tile body. The posts help absorb shock and the space between the hybrid tile and backing plate help to deflect an overpressure blast wave.

Additionally, a rubber, adhesive, hollow microsphere material or other suitable material may be present between the post ends and backing plate and as a filler placed between adjacent posts to further enhance ballistic or blast energy absorption by attenuating shock waves after projectile impact or blast over-pressure.

BRIEF DESCRIPTION OF THE DRAWINGS

The invention is best understood from the following detailed description when read in connection with the accompanying drawings, which illustrate an embodiment of the present invention.

DETAILED DESCRIPTION OF THE INVENTION

A hybrid tile 60 armor system embodying the principles of the present invention is illustrated in FIGS. 8, 13, 14 and 25.

Figure 8:
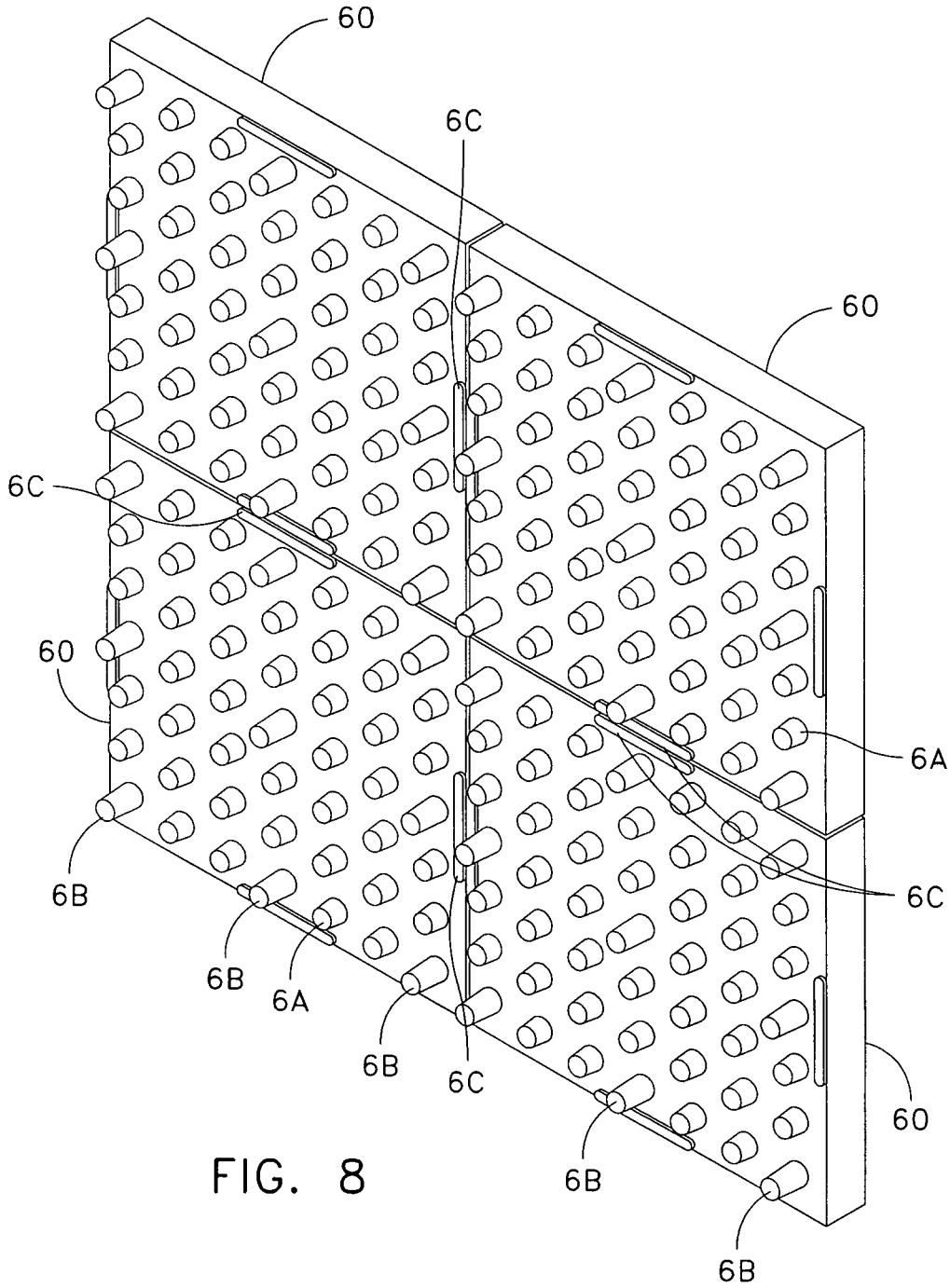
FIG. 8 illustrates a perspective view of four individual demolded hybrid tiles 60 placed adjacent to one another.
Figure 9:
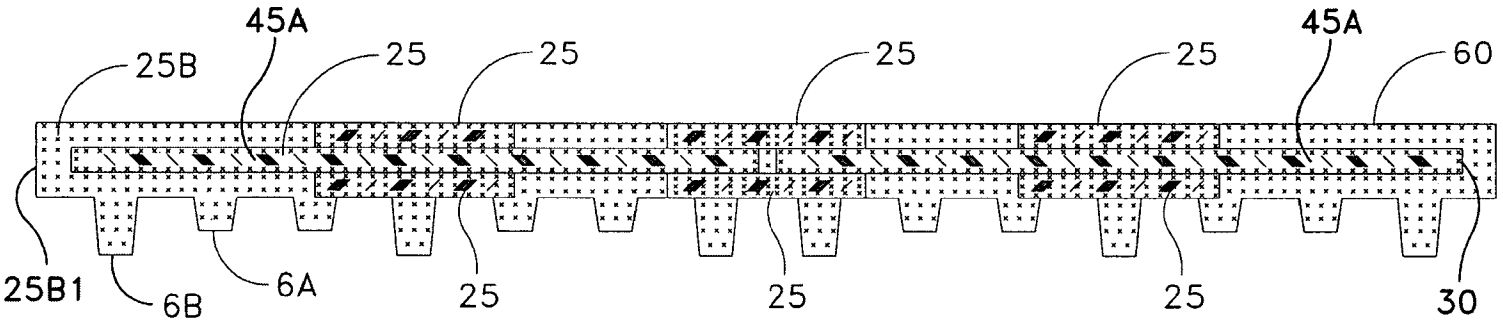
FIG. 9 illustrates a sectional view of a demolded hybrid tiles 60 of FIG. 7.
Figure 14:
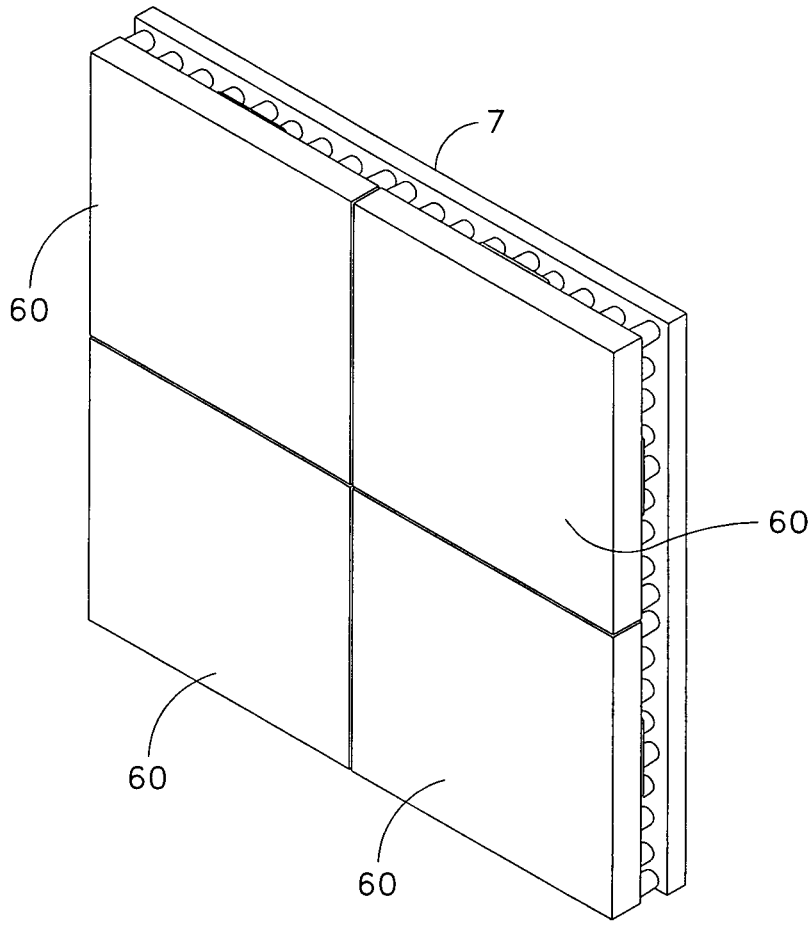
FIG. 14 is a perspective view of the hybrid tiles of FIG. 8 mounted to backing plate 7.
Figure 15:
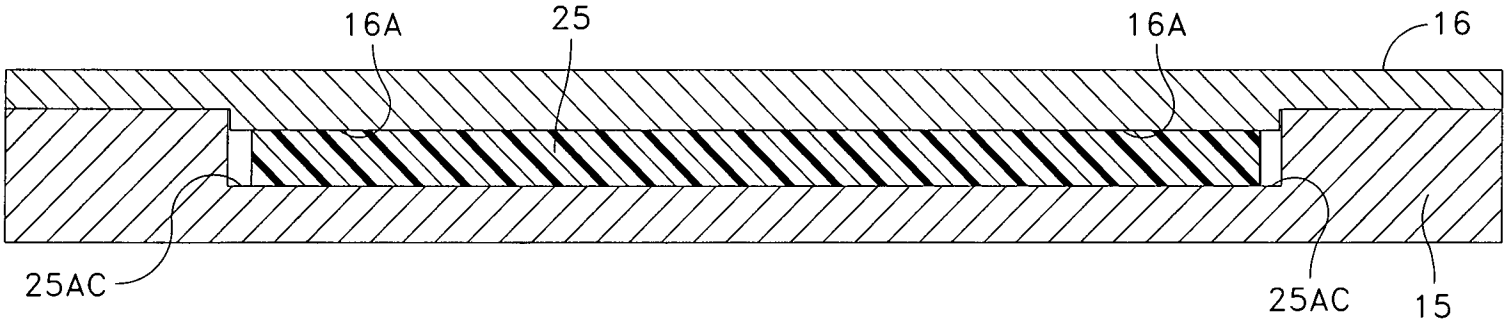
FIG. 15 is a cross section of a mold cavity 15 prior to molten metal infiltration including one material layer having one reinforcement insert 25.
Figure 16:
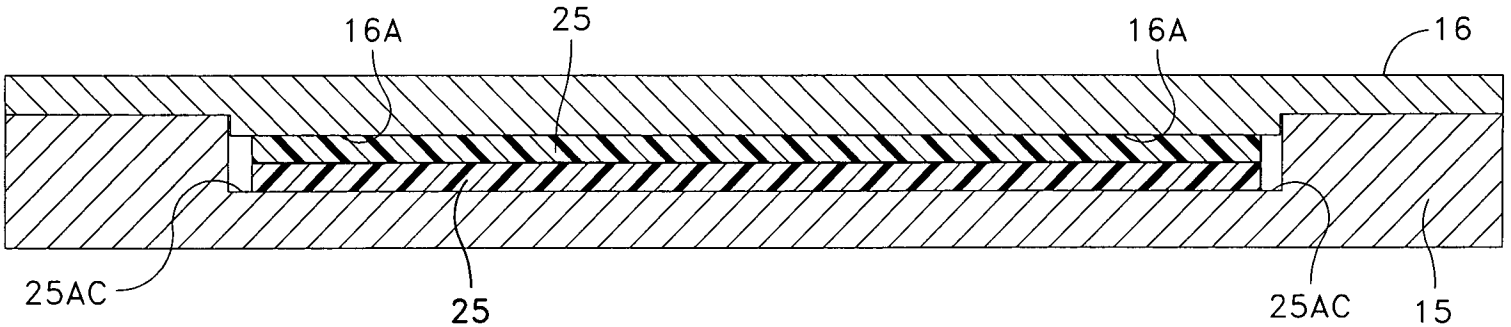
FIG. 16 is a cross section of a mold cavity 15 prior to molten metal infiltration including two material layers each having one reinforcement insert 25.
Figure 17:
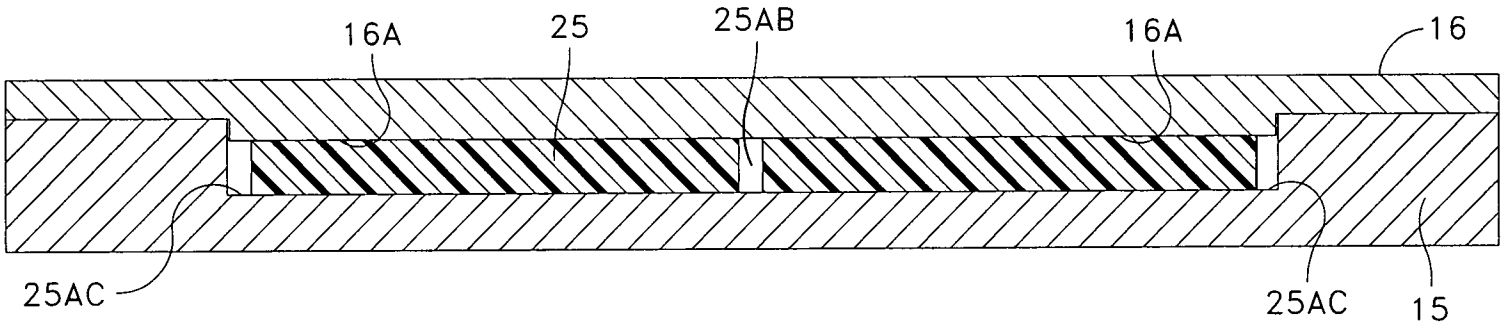
FIG. 17 is a cross section of a mold cavity 15 prior to molten metal infiltration including one material layer having two reinforcement inserts 25.

In the embodiment illustrated in FIGS. 8 and 9 the hybrid tile 60 system comprises energy absorbing post structures 6A, 6B (FIG. 8), and that hybrid tile 60 system may be bonded to a backing plate 7 (FIG. 14). In an alternative embodiment, the hybrid tile 60 system is without the energy absorbing posts 6A and 6B and backing plate 7 (FIG. 18A).

Figure 12:
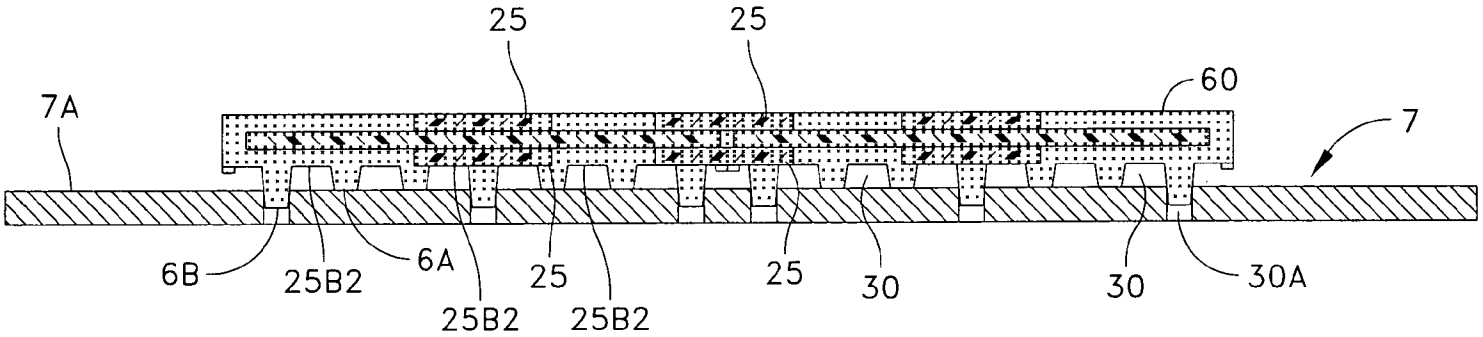
FIG. 12 illustrates the demolded hybrid tile 60 of FIG. 9 secured to a backing plate 7.
Figure 12A:
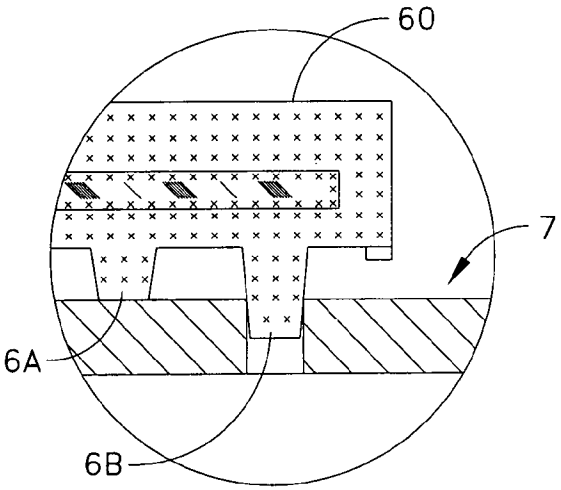
FIG. 12A is an enlarged view of the aluminum plate contact points of FIG. 12 at 6A and 6B.
Figure 25:
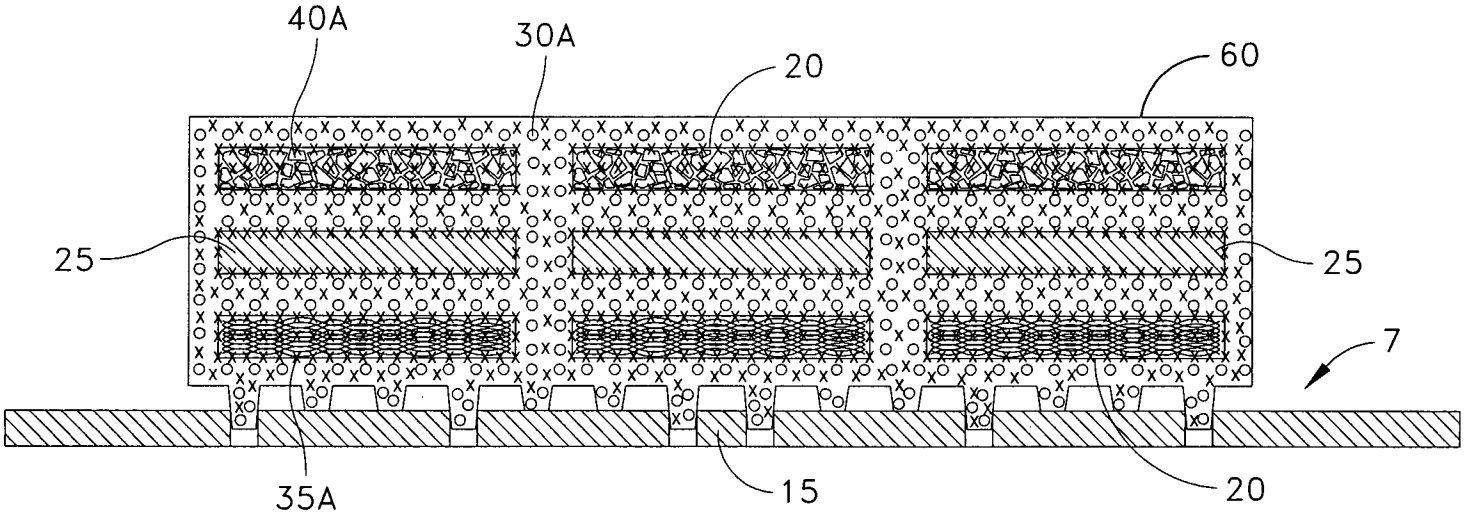
FIG. 25 illustrates the hybrid tile 60 of FIG. 24 attached to a backing plate 7.
Figure 31:
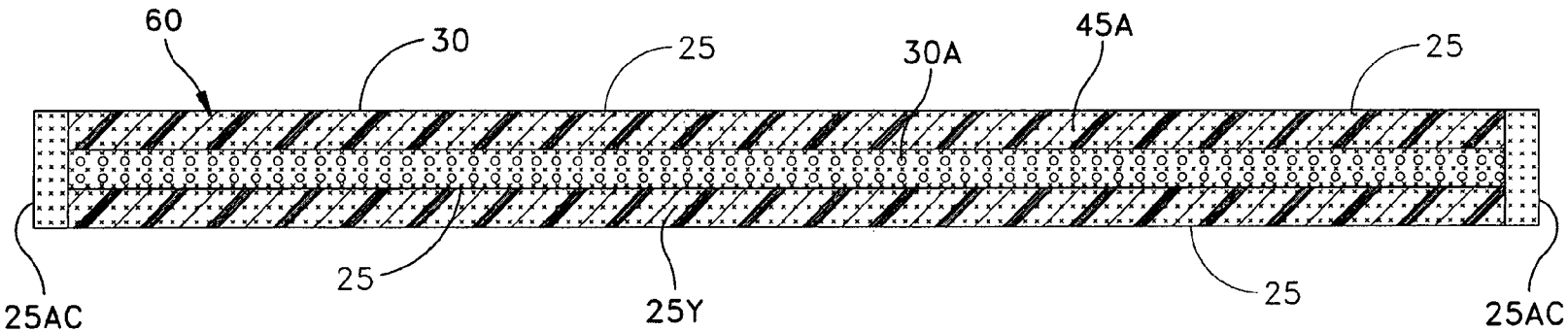
FIG. 31 illustrates a hybrid tile 60 after metal infiltration of the three material layers of FIG. 30, and illustrates infiltration of hollow microspheres 30A middle layer 25 and top and bottom reinforcement layers 25 having open porosity 25Y.

The system is constructed in accordance with a process heretofore described and as illustrated in FIGS. 1 through 5. First a mold cavity 15 is prepared and is typically made from a die suitable for molten metal infiltration casting with the dimensions defined to produce a hybrid tile 60 armor system. The mold cavity 15 is utilized to produce a hybrid tile 60. Each hybrid tile 60 comprises one or more material layers each having one or more reinforcement inserts 25 within a single metal matrix casting. Each material layer within a hybrid tile includes at least one reinforcement insert 25 arranged along a common surface. The reinforcement inserts include material types suitable for containment, structural support, and projectile deflection. As illustrated in FIGS. 9, 12, 18A, 25, and 31 some examples metal matrix composite (MMC) structures of the present invention are disclosed. FIG. 9 illustrates a hybrid tile 60 having spacers as a top and bottom layer inserts and larger inserts for the middle layer. FIG. 9 also illustrates post structures 6A. FIG. 12 illustrates the structure of FIG. 9 secured to a backing plate 7. FIG. 18A illustrates an MMC structure having 2 reinforcement inserts 25 on two separate layers. FIG. 25 illustrates an MMC attached to a backing plate 7, having three reinforcement inserts on each of three layers. FIG. 31 illustrates another embodiment of subject invention, having a single reinforcement insert 25 on each of three layers.

Figure 5:
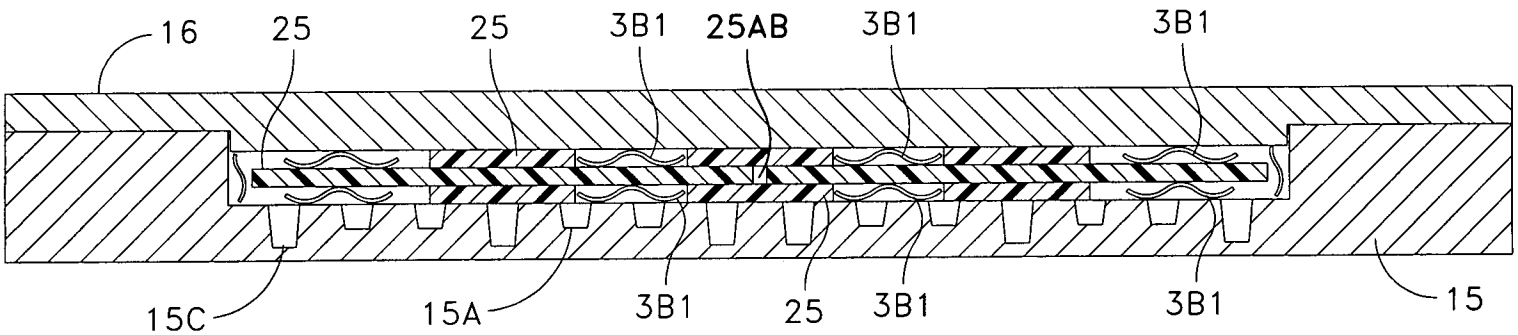
FIG. 5 is a cross-section of FIG. 3B.
Figure 6:
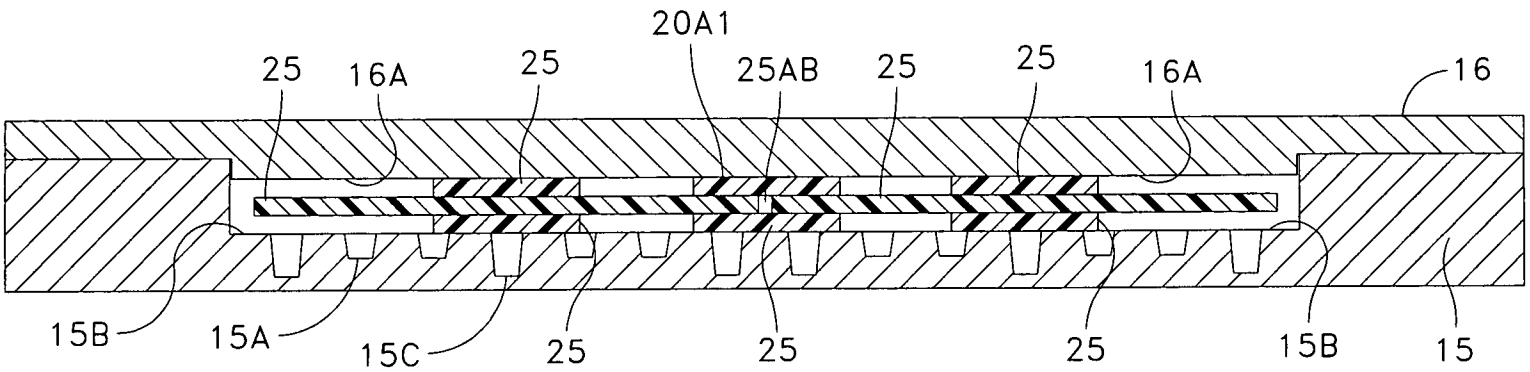
FIG. 6 illustrates a cross-sectional view of the mold cavity 15 prior to molten metal infiltration illustrating a mold cavity cover 16, two outer material layers comprising reinforcement inserts 25 (acting as spacers), a center material layer having reinforcement inserts 25, and a mold cavity base 15B with machined post cavities 15A and 15C therein.
Figure 7:
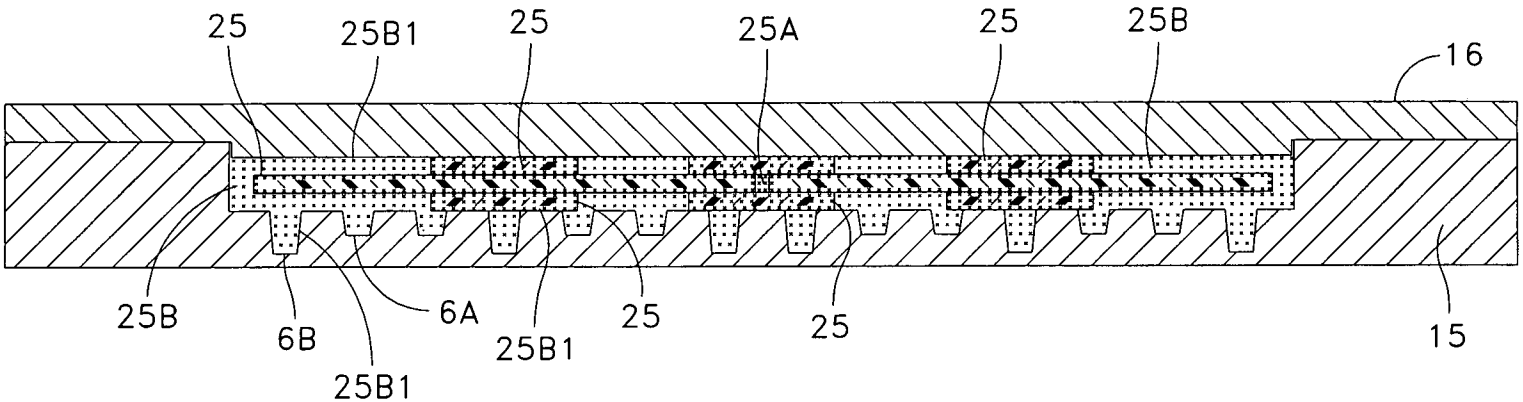
FIG. 7 illustrates a cross-sectional view of the mold cavity of FIG. 6 after molten metal infiltration denoting the molten metal as "x".

The term "tiles" is not limited to a rectangular construction but should be interpreted broadly to include reinforcement inserts 25 of any dimension. In a first embodiment, and referring to FIGS. 1-10 the reinforcement inserts 25 on the outer layers act as spacers to reinforce and provide spacing between the center layers of the hybrid tile 60 armor system as illustrated in FIGS. 6 and 7.

The dimensions of the mold cavity may be flat or include compound curves required for applications such as personal body armor. In the embodiment including energy absorbing post structures, mold cavity 15 includes a plurality of openings 15A and 15C milled into mold 15 bottom surface 15B which are subsequently filled with molten metal during the infiltration casting process to form posts 6A and 6B (see FIG. 7) which are integral to and part of containment layer 25B1 and extend outward from reinforcement inserts 25 (see FIG. 7) that are placed within the mold cavity 15. In the embodiment of the present invention without energy absorbing posts the mold cavity would be without openings 15A and 15C, hence mold 15 would comprise a solid bottom surface 15B as illustrated in FIGS. 15-18A.

Figure 1:
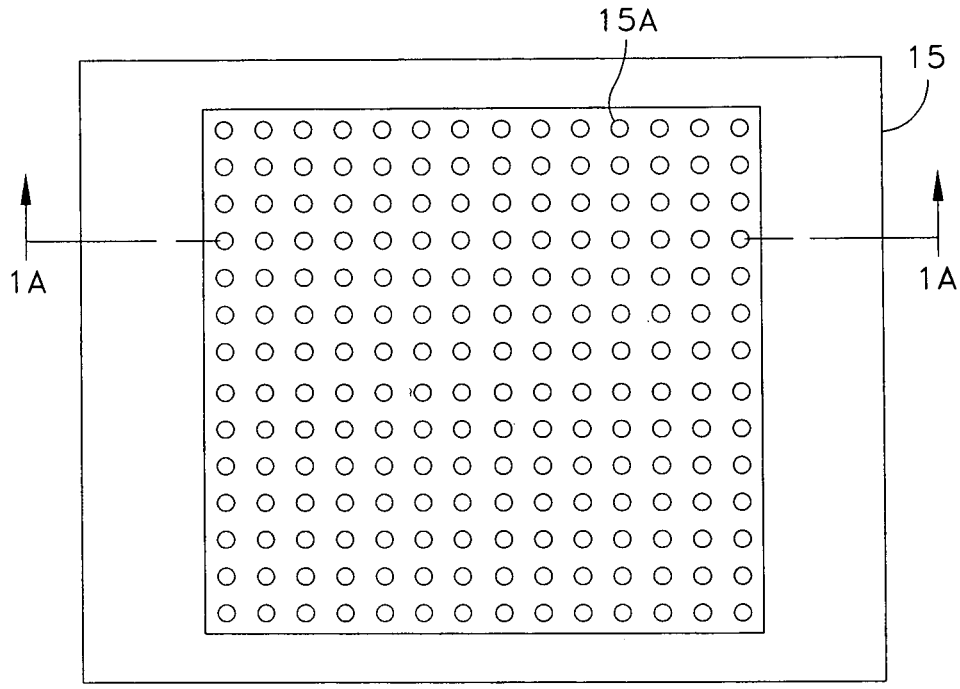
FIG. 1 is a top view of the mold cavity 15 utilized in the production of the post structure embodiment of the hybrid tile system of the present invention, illustrating the machined holes for the fabrication of the hybrid tile post structures.
Figure 1A:
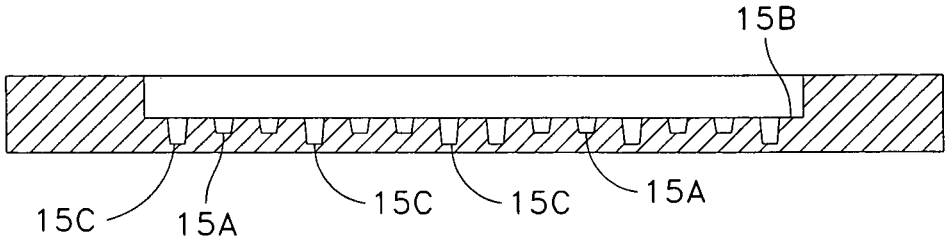
FIG. 1A is a cross-section of FIG. 1 illustrating the varying depth machined holes 15A and 15C.

Referring to FIG. 1A, openings 15A within mold 15 bottom surface 15B may be a fixed length ranging from about 0.020 inches to about 0.5 inches or more but may also include a plurality of longer openings 15C (to form posts 6B) to facilitate bonding of the hybrid tile system 60 to an optional backing plate 7 as illustrated in FIG. 12. It is also contemplated that the length of openings 15A may be varied throughout the mold cavity 15 according to a particular application requiring either specific length posts for energy absorption requirements or for mounting requirements.

The density of openings 15A could range from about 2% to about 40% of the surface area of bottom surface 15B. Various arrays of tiles, may be utilized (1×1, 2×2, 4×4, 2×8, etc) within a hybrid tile 60 and multiple hybrid tiles 60 may be mounted on the area to be protected as illustrated in FIG. 14.

Figure 2:
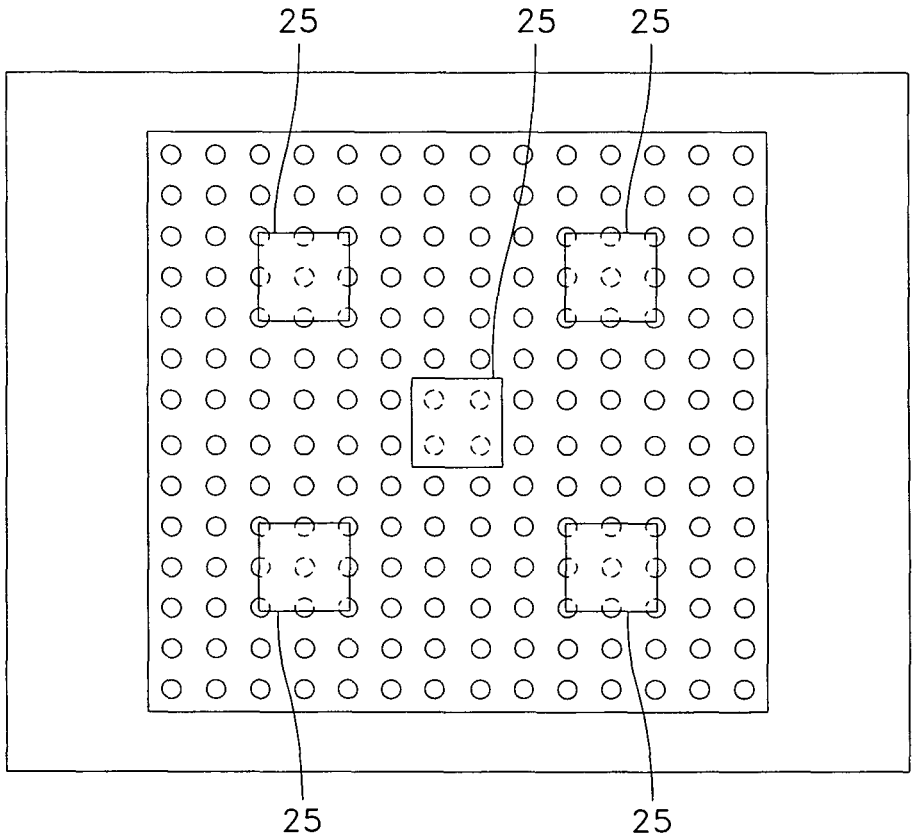
FIG. 2 illustrates reinforcement inserts 25 acting as spacers placed within the mold cavity of FIG. 1.
Figure 3:
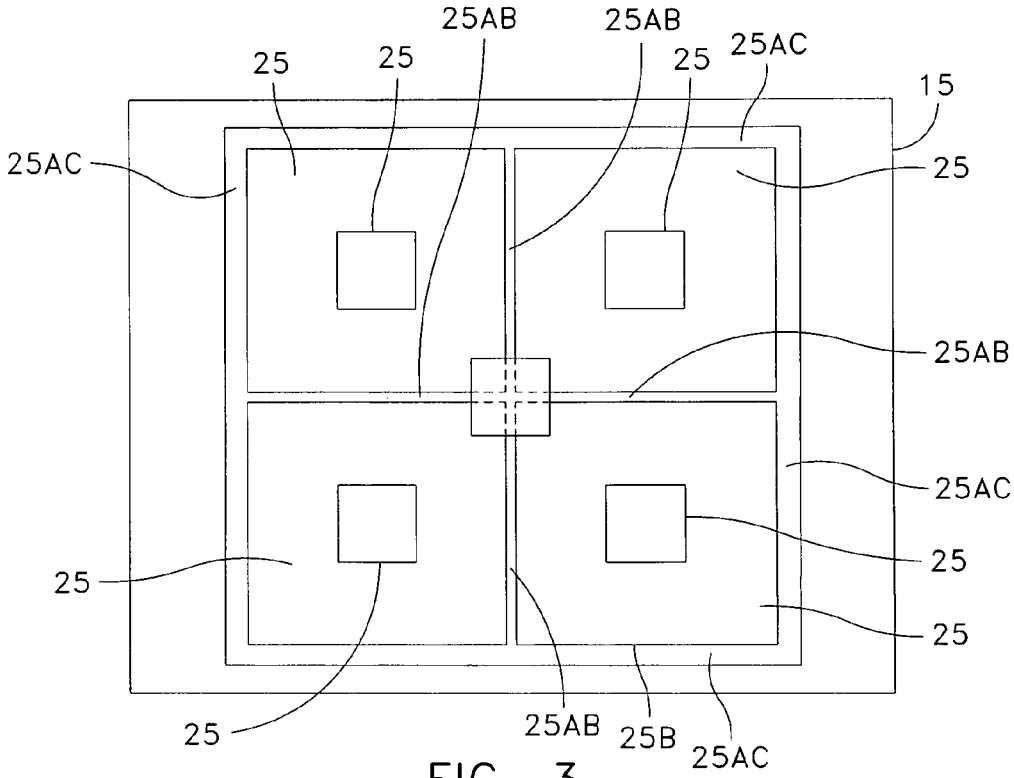
FIG. 3 illustrates the mold cavity 15 of FIG. 2 containing reinforcement inserts 25 stacked on the first set of reinforcement inserts 25 (acting as spacers (FIG. 2)) and a second set of reinforcement inserts 25 (acting as spacers (FIG. 3)) placed on top of reinforcement inserts 25.
Figure 3A:
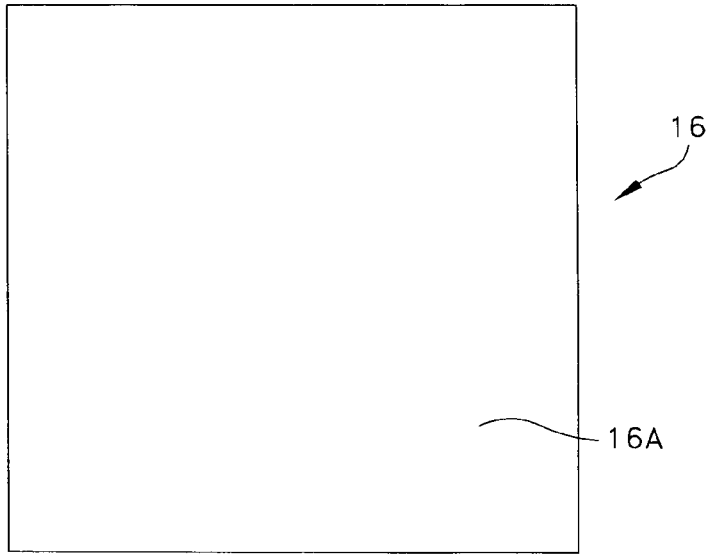
FIG. 3A illustrates mold cavity cover 16 for the mold cavity 15 of FIG. 3.

In one embodiment, hybrid tile 60 is constructed as depicted in FIGS. 2 and 3 and described herein. It is understood that the dimensions, shapes and thicknesses of individual reinforcement inserts 25 that comprise the material layers may be changed according to a particular application.

In a one embodiment of the present invention reinforcement inserts 25 act as spacers on the top and bottom material layers of subject invention. Referring to FIGS. 1A through 3, and FIG. 6, a first layer of one or more reinforcement inserts 25 (acting as spacers) having a total surface area equal to or less than the middle layer of reinforcement inserts 25 surface area, and from about 0.005 inches to about 0.5 inches or more thickness, is next set on mold 15 bottom surface 15B in a location suitable to uniformly raise the bottom surface of the middle layer of reinforcement inserts 25 placed on top above bottom surface 15B. Typically, the reinforcement inserts 25 acting as spacers range from about 0.25 inches by 0.25 inches at a minimum but may be larger as required and cover the entire surface area of the mold cavity.

Figure 10:
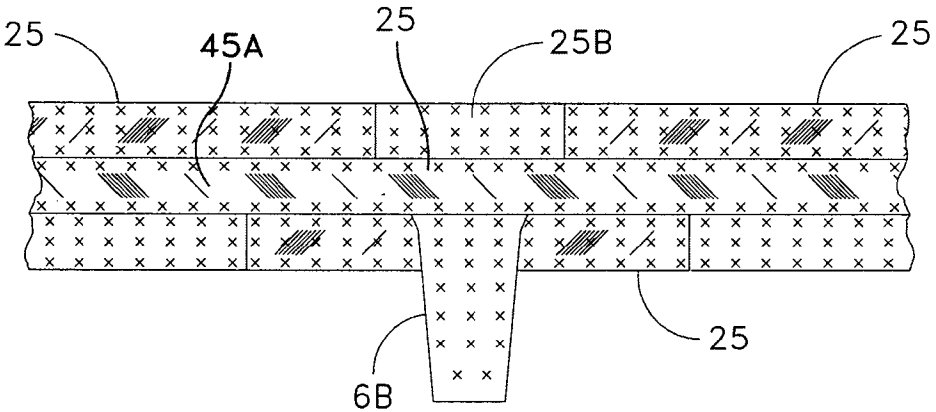
FIG. 10 illustrates a sectional view of post 6B of hybrid tile 60 after metal infiltration.

The reinforcement inserts 25 also serve as a reinforcement point to enhance stiffness of the hybrid tile 60 armor system and may also act to anchor posts 6A and 6B as illustrated in FIG. 10. Reinforcement insert 25 may also include a through hole in selected locations covering openings 15A whereby the through hole would extend into opening 15A providing a solid post structure that extends into reinforcement insert 25 and enhances the bond of posts 6A and 6B to the hybrid tile 60. Referring to FIG. 10, a post 6B is shown with the metal infiltrant extending into reinforcement insert 25 opening or through hole. These reinforced posts can be selected for either posts 6A or 6B according to ballistic threat requirements.

Figure 18:
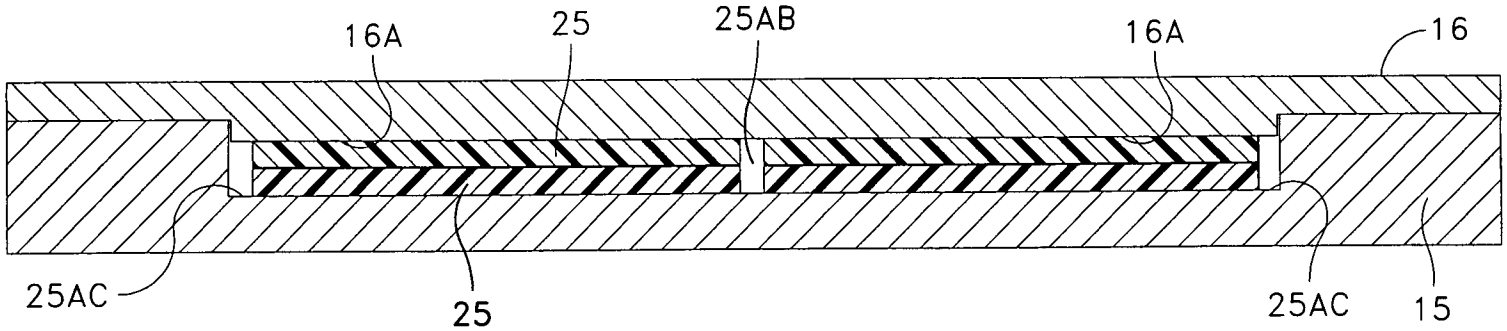
FIG. 18 is a cross section of a mold cavity 15 prior to molten metal infiltration including two material layers each having two reinforcement inserts 25.
Figure 18A:
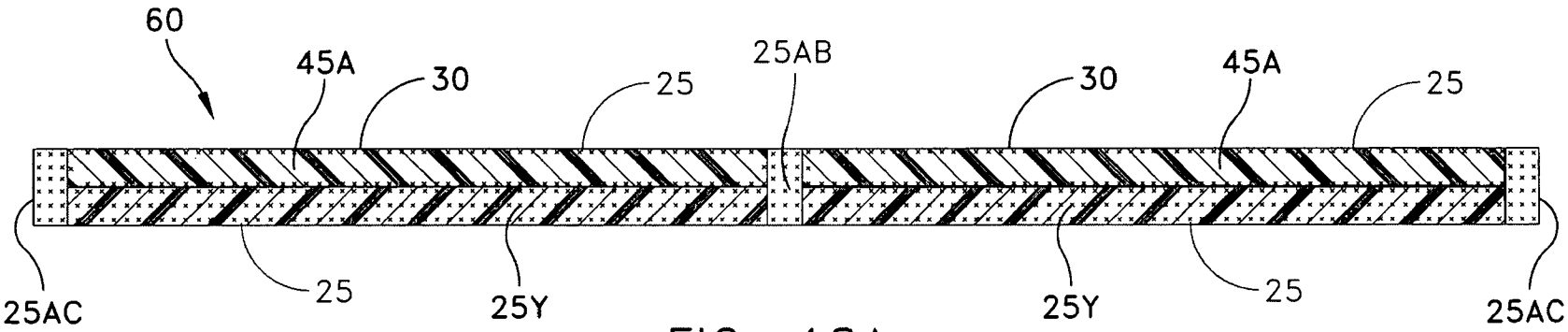
FIG. 18A illustrates a hybrid tile 60 after metal infiltration and without posts 6A and 6B.

In one embodiment, the thickness of reinforcement inserts 25 can range from about 0.020 inches to about 2 inches or more or may mirror each other as illustrated in FIG. 18. In one embodiment, reinforcement inserts 25 are set in the mold cavity such that space between adjacent inserts (inner seams 25AB) is between about 0.01 to about 0.5 inches and the space between the tile outer periphery and the mold cavity internal side (outer seam 25AC) is at least ½ of the inner seam 25AB and alternatively may be multiple times thicker. It is contemplated that other inner and outer seam dimensions may also be utilized without deviating from the scope of the present invention.

The inner and outer seams defined above are maintained via small reinforcement inserts 25 which act as alignment spacers to keep the reinforcement inserts from shifting during metal infiltration. The alignment spacers can be a soft metal or hard ceramic, porous or dense material. The outer seam 25AC extends around the periphery of the layered materials and the inner seams 25AB are located between adjacent reinforcement inserts 25 when at least two inserts 25 are present in at least one material layer. At least one inner seam 25AB may be filled with any reinforcement insert 25 defined herein. Any portion up to and including the full outer seam 25AC may be filled with a reinforcement insert 25 defined herein. FIGS. 26-29 illustrate alternative reinforcement inserts 25 that could be used to fill seams 25AB and 25AC. The reinforcement inserts 25 positioned in the inner seams 25AB and the outer seam 25AC are alternatively referred to as "second reinforcement inserts" for clarity.

Figure 26:
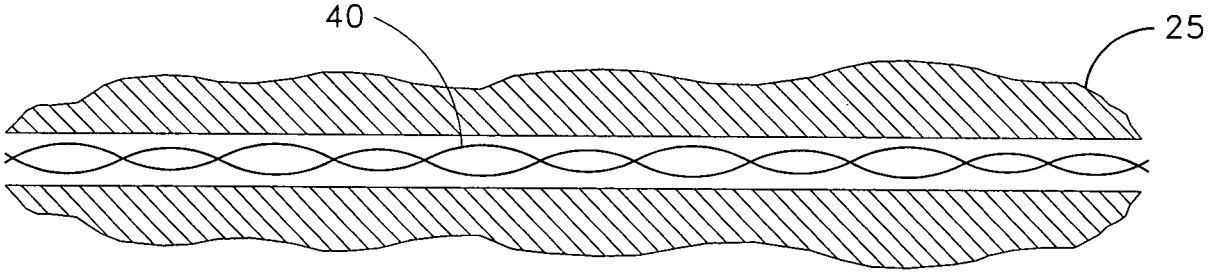
FIG. 26 illustrates a reinforcement insert 25 of filler material 40 made from ceramic fiber roving or yarn.
Figure 27:
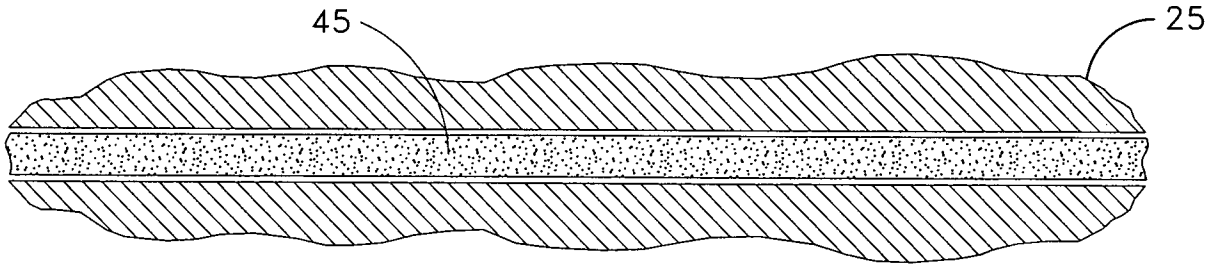
FIG. 27 illustrates a reinforcement insert 25 of molded or extruded particulate 45 held together with a fugitive binder.
Figure 28:
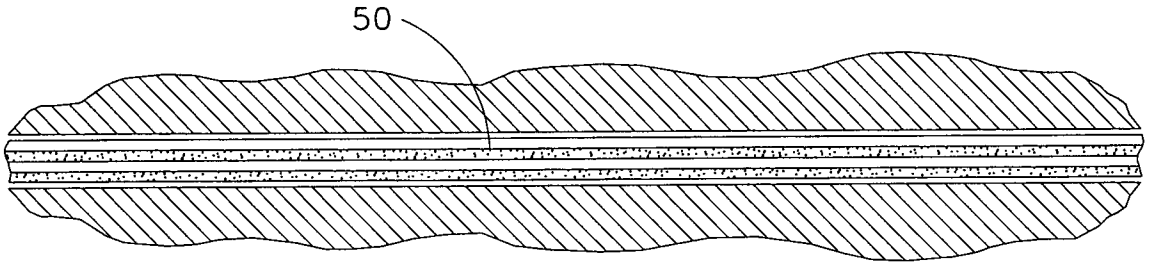
FIG. 28 illustrates a reinforcement insert 25 of densely packed layers of uniaxial ceramic fibers 50.
Figure 29:
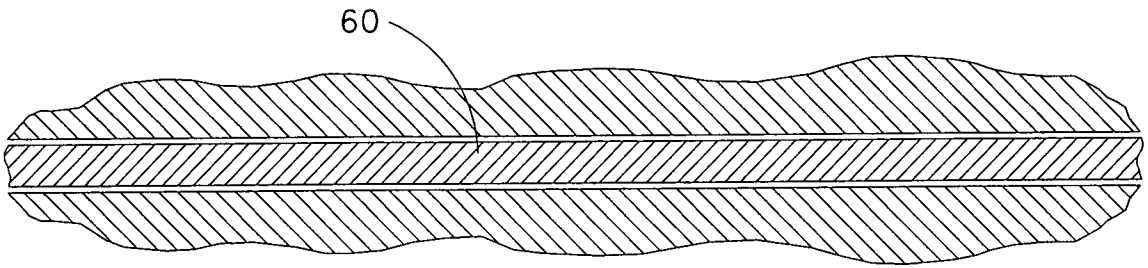
FIG. 29 illustrates a reinforcement insert 25 of metal 60.

FIG. 26 illustrates an insert 25 comprised of filler material 40 made from one or more layers of fabric made from ceramic fiber roving or yarn and is approximately the same thickness as the inner or outer seams. FIG. 27 illustrates an insert 25 comprising filler material 45 of one or more layers of molded or extruded particulate held together with a fugitive binder. FIG. 28 illustrates an insert 25 comprising filler material 50 of densely packed layers of uniaxial ceramic fibers within a fugitive binder. FIG. 29 illustrates an insert 25 comprising filler material 60 of a sheet or plate of metal that can be equal to or less than the size of the seam.

Figure 4:
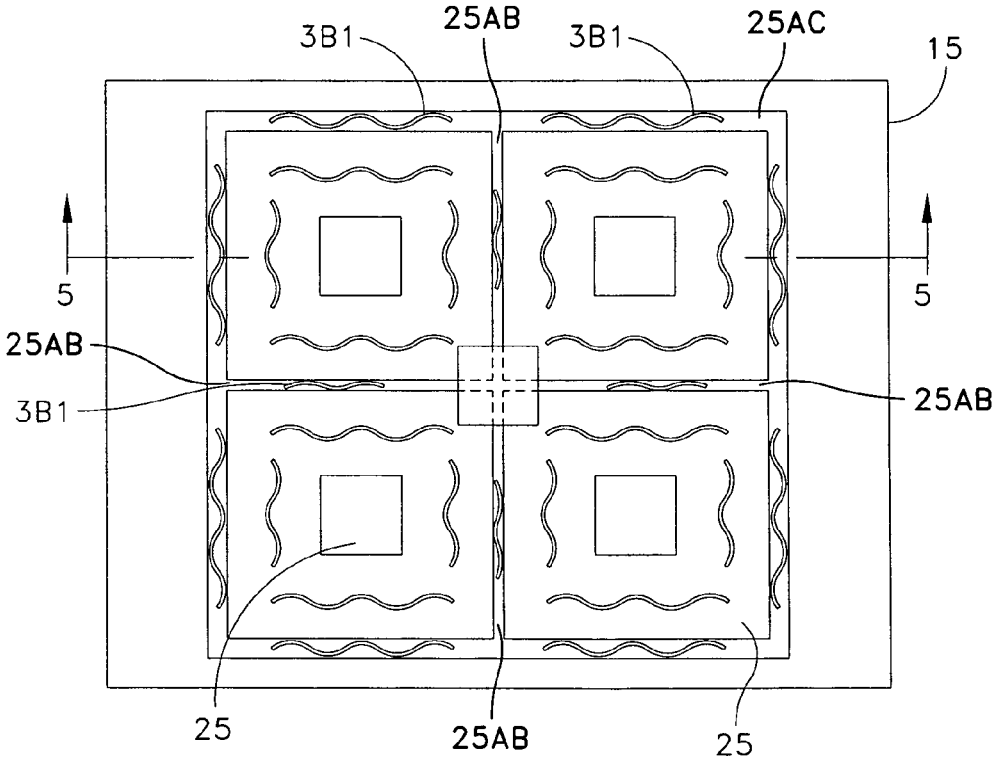
FIG. 4 illustrates the mold cavity 15 of FIG. 3 with rebar reinforcements 3B1 placed on the tops of reinforcement inserts 25, and within the inner seams 25AB and outer seam 25AC.

Referring to FIG. 4, wire 3B1 constructed of Ni, or any other alloy of Ni—Fe, Ti, steel, etc, acting as a "re-bar" reinforcement, may be placed on the top surface of reinforcement inserts 25, in inner seams 25AB and in outer seam 25AC. Referring to FIG. 5, wire 3B1 may also be placed in open spaces below tile 25 and above tile 25 in a similar manner as illustrated in FIG. 4. The thickness of wire 3B1 ranges from approximately 0.0005 inches to about 0.5 inches.

Other possibilities contemplated for the "rebar" reinforcement may include various configurations of rods, woven fibers or wires, or metal sheets, placed around the edges of the mold cavity, over the surface of the ceramic tiles, and between the tiles, to create a reinforced ductile metal or stiff Metal Matrix Composite (MMC) skin. Referring to FIG. 4, other alternative seam filler materials to substitute for wire 3B1 include all reinforcement insert 25 materials described in herein detailed description.

Figure 19:
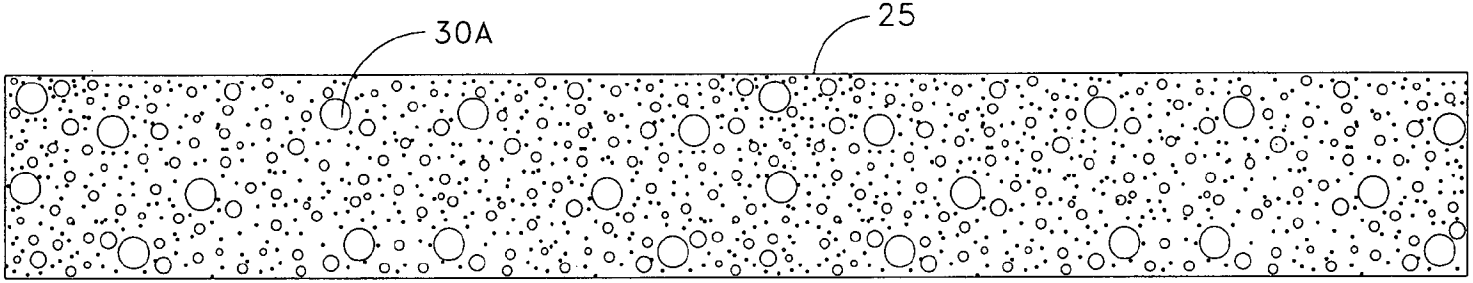
FIG. 19 illustrates a reinforcement insert 25 of hollow microsphere filler material 30A.
Figure 23:
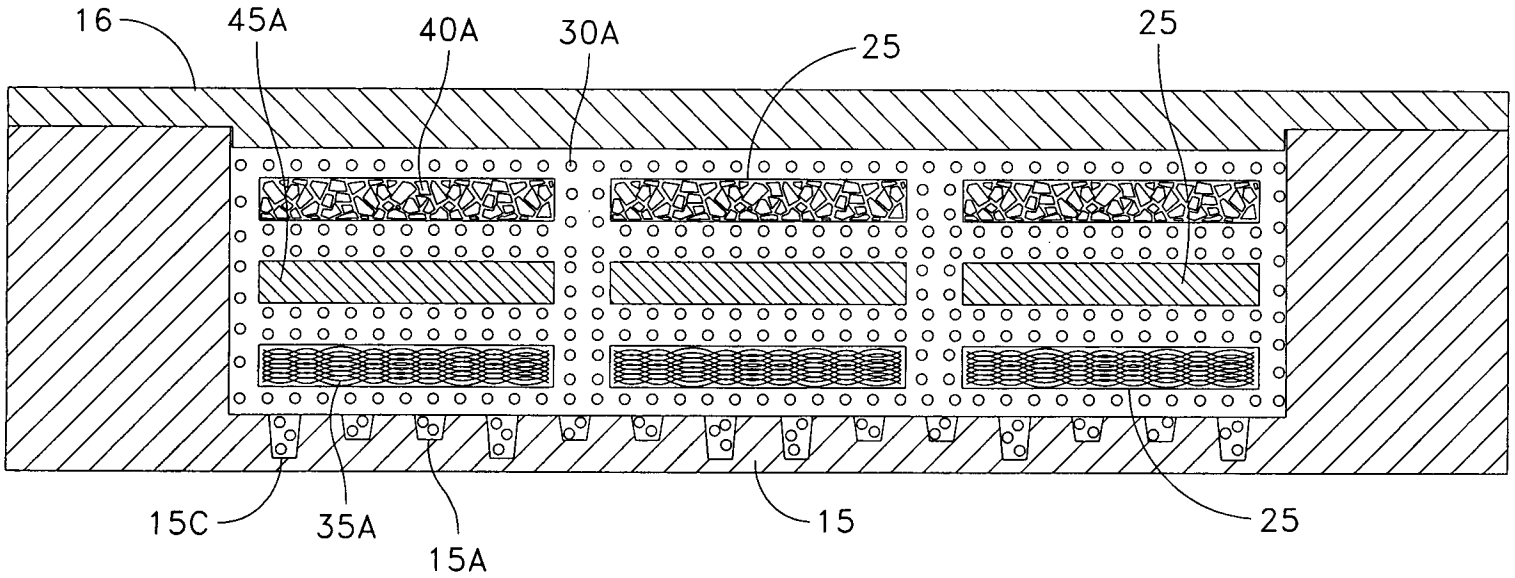
FIG. 23 illustrates a cross-sectional view of the mold cavity 15 prior to molten metal infiltration illustrating a mold cavity cover 16, a material layer of three reinforcement inserts 25 with structure support material 35A, a material layer of three reinforcement inserts 25 with dense material 45A, a material layer of three reinforcement inserts 25 with strike face material 40A, and a hollow microsphere material 30A dispersed within the open space within the mold cavity.

As illustrated in FIG. 23, multiple material layers of reinforcement inserts 25 comprising varying material types act to enhance the overall performance of the armor system. The material types are described as being embodied in an "insert" structure, however, the term "insert" should not be limited to a rectangular structure but should be interpreted to include material types contained within any dimension. To improve the hybrid tile armor's ability to absorb energy while decreasing the weight of the armor tile system high volume hollow microspheres 30A with interior voids, as illustrated in FIG. 19, are utilized as one or more reinforcement inserts 25. The microspheres may be contained in a "insert" structure (FIG. 19) but may also be dispersed randomly throughout mold cavity 15 as illustrated in FIG. 23.

To improve the hybrid tile armor's structural integrity and to prevent delamination of the armor structure one or more reinforcement inserts 25 of three dimensional (3-D) sintered or woven wire mesh 35A is integrated into the armor tile system as illustrated in FIG. 23. The wire mesh serves to anchor the metal infiltrant to the mesh thereby adding structural stability to the armor structure. Furthermore, to improve the hybrid tile armor's ability to deflect and initiate fracture to an incoming projectile reinforcement inserts 25 of angular faceted hard particles 40A are incorporated in the material layer at the armor's strikeface as illustrated in FIG. 23.

Figure 30:
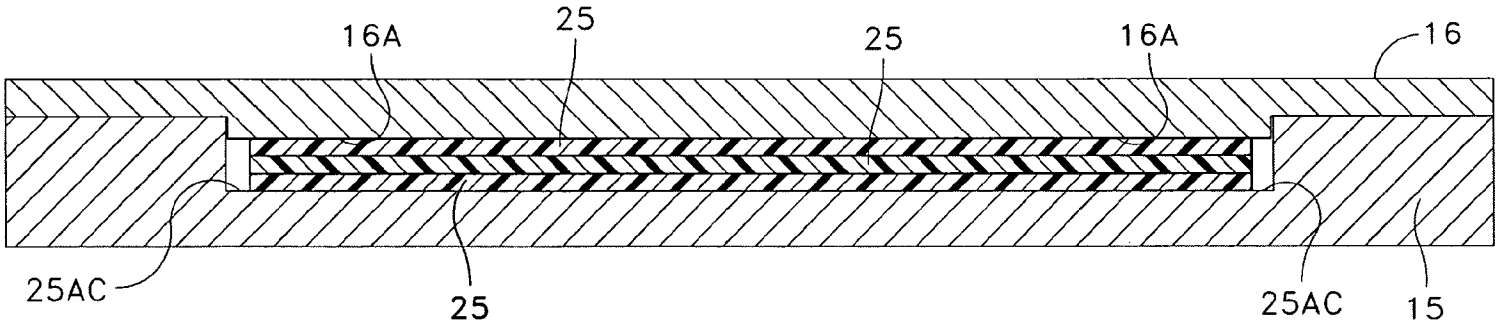
FIG. 30 is a cross section of a mold cavity 15 prior to molten metal infiltration including three material layers each having one reinforcement insert 25.

The hollow microsphere material 30A comprises a lightweight, inert hollow spheres filled with air and/or gas with a density about 0.4 to 1.6 grams/cubic-centimeter. The hollow microspheres 30A are denoted by "ooo" in FIG. 23 and the metal infiltrant denoted by "XXX" in FIG. 24 after metal infiltration. Microsphere material 30A is dispersed randomly throughout mold cavity 15. The hollow microspheres are hermetic, and do not collapse or fill with metal during the metal infiltration process. The hollow spheres have been demonstrated by the inventor to be strong enough to withstand the pressure of metal infiltration casting and will not soften or crush under extreme metal infiltration temperatures greater than 600 degrees celsius. Furthermore, the hollow spheres did not degrade or dissolve due to chemical reactions with the metal infiltrant. In another embodiment of the present invention, as illustrated in FIG. 30, a single reinforcement insert 25 of hollow microsphere material 30A as a middle layer, and a top and bottom layer comprising a single reinforcement insert 25 having any interior open porosity, or no open porosity as defined herein is disclosed. FIG. 31 illustrates, the embodiment of FIG. 30, after metal infiltration, having an infiltrated microsphere material 30A layer 25 and a top and bottom reinforcement layer 25 of material having open porosity.

In the preferred embodiment, hollow spheres of the cenosphere variety are utilized as the material 30A. However, any ceramic or metallic bubble which is hermetic with the metal infiltrant, has sufficient crush strength, and acceptable reactivity with the infiltrant is acceptable. Cenospheres, a by-product of aluminum fly-ash, has shown to exhibit light weight, and hardness effective in the present invention as bubble material 30A for energy absorption. The cenosphere material 30A has been effective in providing a crush zone to an impacting projectile. Cenospheres are produced as a natural by-product of coal combustion during the generation of electric power. As a portion of the fly-ash generated in coal production, cenospheres are recycled from the waste stream. They are made up of inert silica, iron and alumina, and have a size ranging from 1 to 300 microns with an average compressive strength of 3000 PSI. Cenospheres of low bulk density are produced by Sphere Services, Inc, of Oakridge, Tenn.

Figure 20:
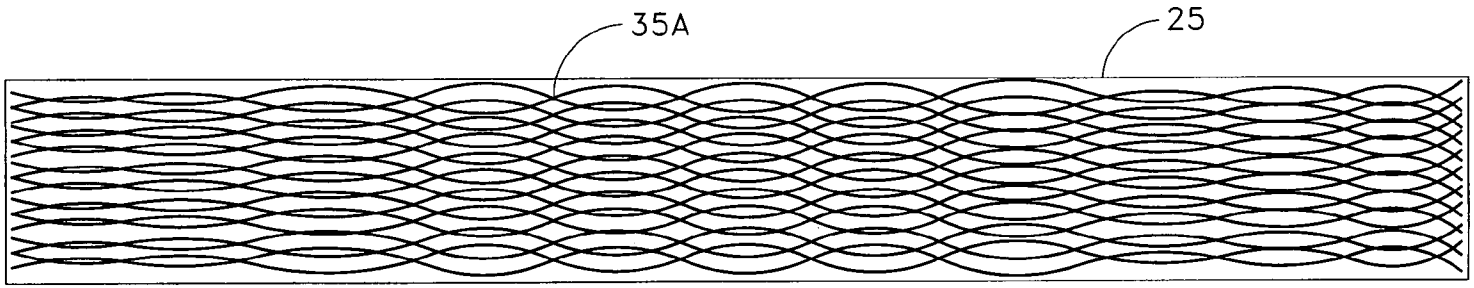
FIG. 20 illustrates a reinforcement insert 25 utilizing a structure support material of 3-D sintered or woven wire mesh 35A.

The layered wire mesh 35A may be comprised of fusion bonded or sintered metal wires to bond the wire material layers as illustrated in FIG. 20 or may be woven to create a three dimensional (3-D) structure. This creates an integrated yet porous reinforcement insert 25 with the 3-D bonded or woven material maximizing the strength of the mesh structure. The wire utilized to create the wire mesh will be inert to aluminum infiltration casting and will retain its properties after infiltration casting and subsequent to the hybrid tile being cooled and demolded. In the preferred embodiment, wire including Titanium (Ti) at a thickness of 0.010 to 0.50 inches is utilized, however wires of steel, stainless steel, and various other alloys may be utilized with or without barrier coatings. The wires must be able to withstand temperatures compatible with molten metal processing of the infiltrant in that the wires do not degrade chemically or mechanically to a level for which the wires do not positively contribute to the reinforcement of the hybrid tile structure.

Figure 22:
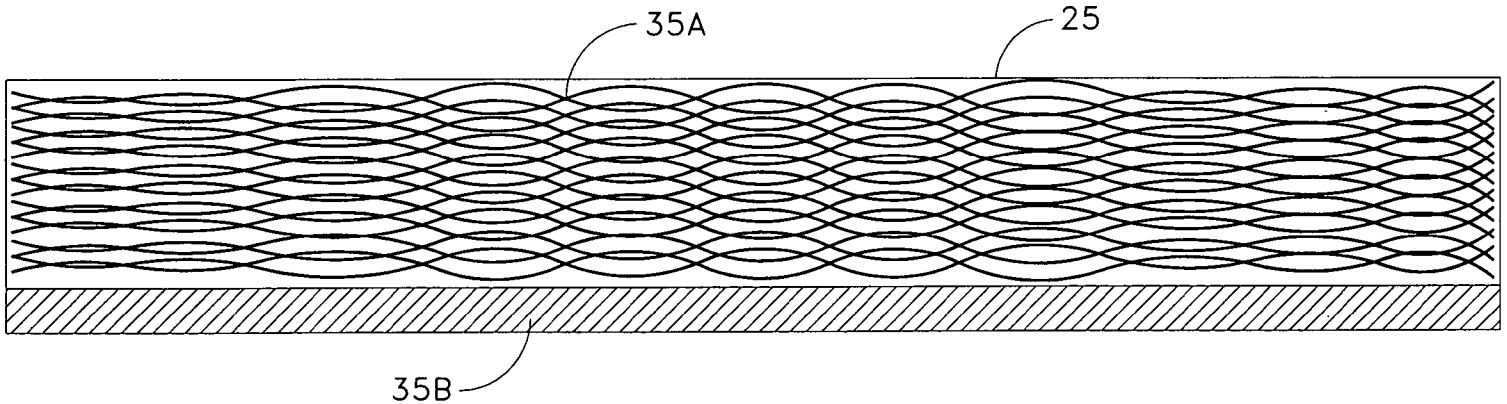
FIG. 22 illustrates a reinforcement material 25 utilizing a structure support material 35A bonded to a metal plate 35B.

The multi-layer mesh structure 35A provides an anchor for the aluminum infiltrant, bonds to layers containing metal, and stiffens the hybrid tile structure. By including material layers of reinforcement insert 25 comprising sintered 3-D wire mesh 35A the complete hybrid tile structure is reinforced and multiple material layers are further reinforced to avoid delamination upon projectile impact. The multi-layer metal mesh structure 35A can also be metallurgically bonded to a metal plate 35B as illustrated in FIG. 22, and this reinforcement 25 combination could be included as a layer within mold cavity 15. Wire mesh structures known in the art such as diffusion bonded 3-D sintered wire mesh produced by Martin Kurz & company, Inc, may be utilized. The wires are produced by a series of technical processes including roller flattening the wires, laminating under mechanical pressure, then diffusion bonding and cooling creating a bonded layered mesh.

Figure 21:
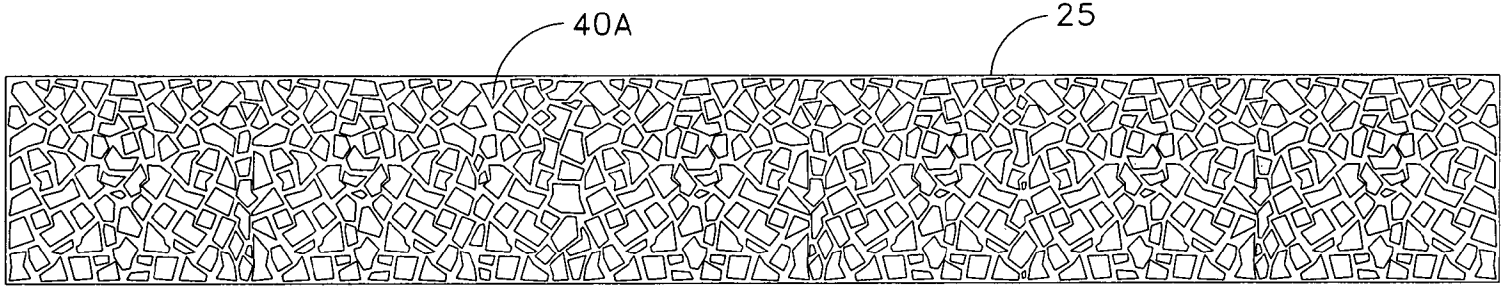
FIG. 21 illustrates a reinforcement insert 25 utilizing a strike face material 40A.

Angular faceted particles 40A may be Silicon Carbide, Boron Carbide, Aluminum Oxide, or other hard materials and be of sizes 0.001 to 1.0 inch or more in diameter. In the preferred embodiment, reinforcement insert 25 incorporating angular faceted particles 40A would be the outermost layer of the hybrid tile system first hit with an incoming projectile. The angular faceted particles 40A provide an improved ability of hybrid tile system 10 to deflect and initiate fracture to an incoming projectile and are illustrated in FIG. 21. A projectile deflected prior to engaging the innermost hybrid tile system layers will have less penetrating energy than a projectile having a normal incidence angle.

The number of material layers is determined by the mold size and desired ballistic resistance. A hybrid tile armor 60 would include at least one material layer comprising at least one reinforcement insert 25, and FIGS. 15-18, and 31 are illustrative of various possible configurations prior to metal infiltration. The mold cavities illustrated in FIGS. 15-18, and 31 do not include energy absorbing posts, however, it is understood that such posts could be optionally implemented. FIG. 18A illustrates another embodiment of a demolded armor plate 60 subsequent to metal infiltration.

Figure 24:
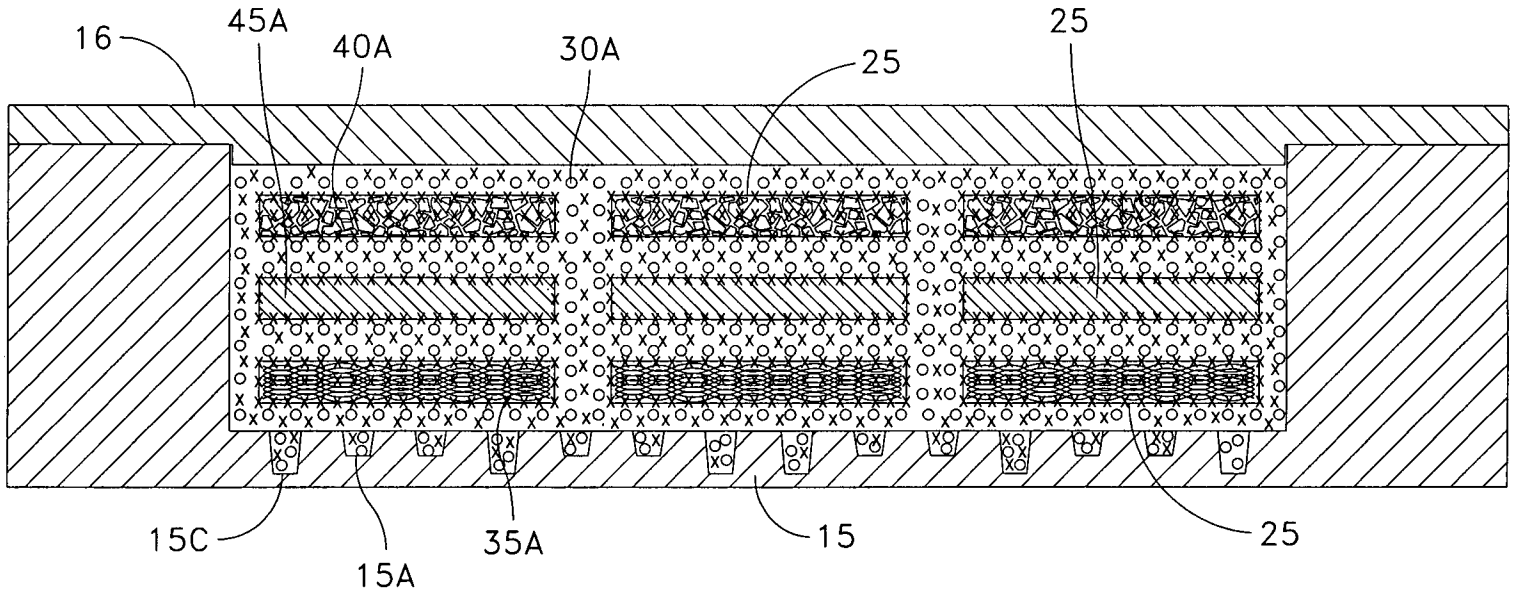
FIG. 24 illustrates the mold cavity of FIG. 23 subsequent to metal infiltration casting.

Reinforcement inserts 25 may comprise a dense material type 45A having a microstructure designed without interconnected porosity and having a predetermined fraction of void volume or open structure at its surface, or zero void volume or open structure at its surface. If a void volume is present it is filled and bonded with molten metal subsequent to metal infiltration casting. Dense materials may be dense ceramic such as aluminum oxide, silicon carbide, boron carbide, silicon nitride, chemical vapor deposit diamond or composites of ceramics. Dense materials may be a dense metal such as titanium, tungsten, molybdenum, and depleted uranium or alloys. Dense material layer 45A is illustrated in FIGS. 23 and 24.

Other suitable dense materials include but are not limited to glass-ceramics, and other inorganic material systems which are compatible with molten metal processing and which can contribute to ballistic resistance of the integrated hybrid tile system. Dense materials such as high strength steels, metal alloys, and ceramic alloys may be used in subject invention. Dense materials include between 0 and 20% surface porosity with the interior of the dense materials not susceptible to metal infiltration.

The dense materials may include "voids" or open spaces within their interior, however, no interconnected porosity is present which would provide a path for metal infiltration from the surface to the interior of dense materials. Reinforcement inserts 25 may also be ceramic or metal and in the form of particulates or fiber. Reinforcement inserts 25 may also be in the form of metal sheets, rods, wires and weaves functioning to separate the material layers. The ceramic and/or metal particulate or fiber reinforcements within the metal matrix include materials such as aluminum oxide, carbon, graphite, silicon carbide, boron carbide, titanium, tungsten, nickel, molybdenum, copper, aluminum and other anticipated ceramics or metal materials.

Reinforcement inserts 25 having an interior open porosity could range between about 0% and about 99% prior to metal infiltration. Referring to FIGS. 5 and 18 mold cavity cover 16 flat bottom surface 16A is next placed upon reinforcement insert 25 (acting as spacer—FIG. 5,) top surface defining the closed mold cavity. Prior to sealing the mold inner and outer seams 25AB and 25AC, may be filled with a reinforcement insert 25 as previously described.

The closed mold cavity is next infiltrated with molten metal. The Al infiltration process causes aluminum to penetrate throughout the overall structure and into any surface open porosity of reinforcement inserts 25 of dense material types, and into the fraction of void volume of reinforcement inserts 25 of porous material types. The material layers become bonded metallurgically or mechanically subsequent to metal infiltration casting.

The Al infiltrant solidifies within and around the material layers extending from one layer interface to the next, thus binding the layers together and integrating the structure. While molten aluminum is the embodiment illustrated other suitable metal infiltrants include but are not limited to aluminum alloys, copper, titanium and magnesium, and other metal alloys cast from the molten liquid phase. The liquid metal infiltration process is described in U.S. Pat. No. 3,547,180 and incorporated herein by reference for all that it discloses.

Referring to FIG. 9 and FIG. 18A, a cross section of the stacked reinforcement inserts is illustrated in two embodiments of the present invention subsequent to metal infiltration. Subsequent to metal infiltration, the metal infiltrant 25B is denoted by the drawing symbol "x". In both FIG. 9 and FIG. 18A, open surface voids within a dense material type infiltrated with metal is illustrated at 30, and shows no infiltration within the interior of reinforcement insert 25 dense material 45A. Mechanical and chemical reactive surface bonding allows the dense material types to bond at their surfaces at metal infiltrant 25B points 30. The metal infiltrant 25B forms a containment layer 25B1 at the periphery of the molds internal cavity upon completion of the Al infiltration process. FIG. 18A further illustrates metal infiltrant "x" penetrating interior porosity 25Y of reinforcement insert 25.

Figure 11:
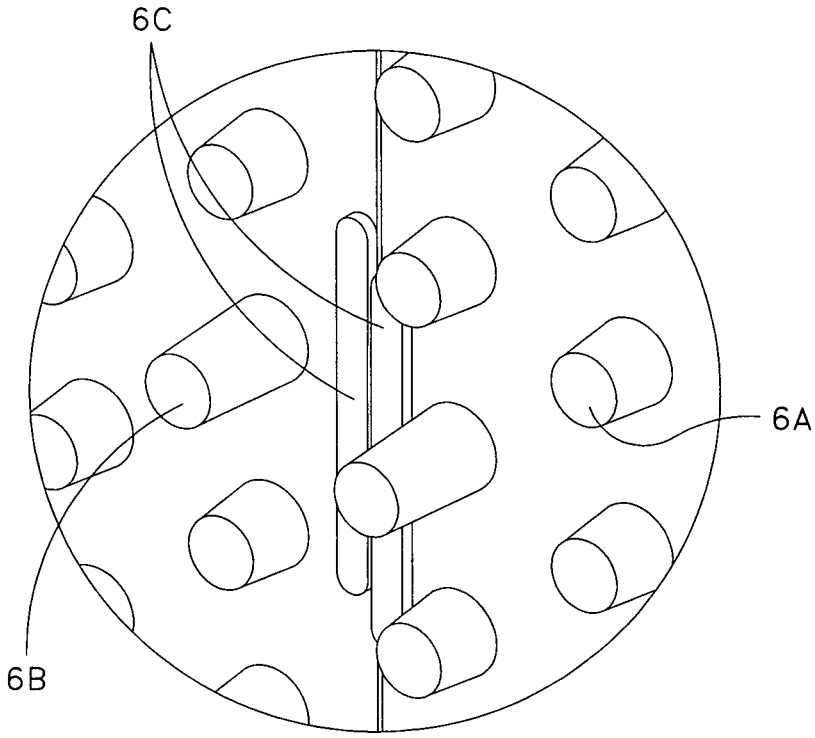
FIG. 11 illustrates a detail view of an example of an aluminum rich rib 6C used for bonding demolded hybrid tile 60 together.

Referring to FIGS. 8,11 and 12, after the metal infiltration process is complete the hybrid tiles 60 are removed from the casting mold 15 and may be welded or otherwise joined at points 6C and 6B to form an array of hybrid tiles 60 (FIG. 8) and enhance the rigidity of the array structure. A similar array of hybrid tiles 60, without energy absorbing posts 6A and 6B, may also be joined similar to FIG. 6.

As illustrated in FIG. 12, when a backing plate 7 is utilized, the backing plate top surface 7A is spaced away from bottom surface 25B2 of hybrid tiles 60 and may be substantially parallel thereto. Tile panel 60 may be welded to a backing plate 7 via elongated posts 6B being recessed into backing plate 7 through a bore formed therein and posts 6B welded within the bore. In the embodiment illustrated, the top of posts 6A would be flush with the top surface of backing plate 7 creating a gap 30 between posts 6A and 6B, the gap acting to deflect or disperse ballistic shock and impact and blast overpressure. Other possibilities include shorter posts 6A that are raised above the top surface of backing plate 7.

Figure 13:
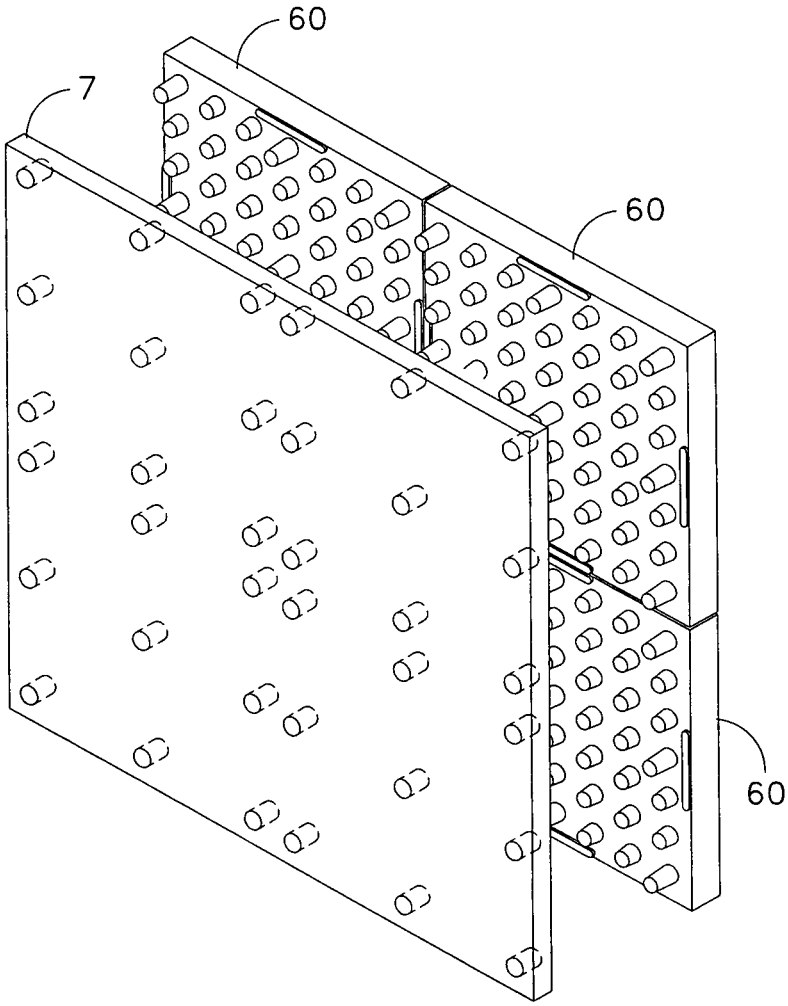
FIG. 13 is a perspective view of four demolded hybrid tiles 60 and backing plate 7.

A space 30A may be created below post 6B depending on the depth of the bore into backing plate 7 and extent to which post 6B is inserted into the bore. The backing plate 7 serves as a mounting platform to attach the hybrid tile 60 system to the object requiring protection. The backing plate 7, may be made of aluminum, steel, titanium, fiber reinforced epoxy, or other metal or composite structures. As illustrated in FIG. 13, a plurality of hybrid tiles 60 may be mounted adjacent each other at a distance from about 0 to about 0.01 inches for optimum ballistic deterrence.

Rubber or viscous shock absorbing material and bubble material 30A may be utilized to fill the gaps 30 between posts 6A and 6B, under post 6A (where post 6A is raised above top surface of backing plate 7), and within space 30A to further attenuate any shock waves resulting from an impact blast. The post 6A and 6B diameter, length and spacing can all influence the rigidity of the hybrid tile structure and subsequent cushioning effect upon ballistic impact or blast. The frequency of the posts 6A and 6B bonded to the backing panel 7, and method of attachment also influence the rigidity of the structure.

Although the description above contains many specificities, these should not be construed as limiting the scope of the embodiment but as merely providing illustrations of some of the presently preferred embodiments. Rather, the scope of the invention is to be determined only by the appended claims and their equivalents.

We claim:

1. A hybrid tile metal matrix composite armor, formed by placing at least one material layer in a closed mold cavity, the outer periphery of the at least one material layer and the mold cavity inside periphery having a space defining an outer seam, comprising:

at least one material layer, said at least one material layer comprising at least one first reinforcement insert arranged along a common surface, said at least one first reinforcement inserts comprising a reinforcing material having a fraction of void volume, said first reinforcement inserts having at least one inner seam between a plurality of said at least one first reinforcement inserts;

said at least one material layer further comprising an outer seam, said fraction of void volume in said at least one reinforcement material and said inner seam and said outer seam further comprising a metal, said metal infiltrated within said fraction of void volume and within said inner and outer seams, said metal infiltration forming an encapsulating layer within said outer seam.

2. A hybrid tile metal matrix composite armor as in claim 1, wherein said reinforcement material fraction of void volume ranges from about 0 percent to about 99 percent.

3. A hybrid tile metal matrix composite armor as in claim 1, further comprising a second reinforcement insert, said second reinforcement insert positioned in at least one of said at least one inner seam between said plurality of said at least one first reinforcement insert, said second reinforcement insert having a fraction of void volume, said void volume further comprising a metal infiltrated within said void volume.

4. A hybrid tile metal matrix composite armor as in claim 1, further comprising a second reinforcement insert, said second reinforcement insert positioned in said outer seam, said second reinforcement insert having a fraction of void volume, said void volume further comprising a metal infiltrated within said void volume.

5. A hybrid tile metal matrix composite armor as in claim 4, wherein said second reinforcement insert is positioned in a portion of said outer seam.

6. A hybrid tile metal matrix composite armor as in claim 1, wherein said encapsulating layer further includes a plurality of post structures extending outward therefrom.

7. A hybrid tile metal matrix composite armor as in claim 6, wherein said plurality of post structures have variable diameters, lengths, and spacings therebetween.

8. A hybrid tile metal matrix composite armor as in claim 6, further including a backing plate, said backing plate affixed to said plurality of post structures extending outward from said encapsulating layer.

9. A hybrid tile metal matrix composite armor as in claim 8, wherein said backing plate includes top surface mounting recesses, said mounting recesses engaging said plurality of post structures extending outward from said encapsulating layer.

10. A hybrid tile metal matrix composite armor as in claim 8, wherein said plurality of post structures include a fixed length plurality of short and long posts.

11. A hybrid tile metal matrix composite armor as in claim 10, wherein said backing plate includes top surface mounting recesses, said mounting recesses engaging said plurality of long fixed length posts up to a point when said plurality of short fixed length post ends are flush with said backing plate top surface.

12. A hybrid tile metal matrix composite armor as in claim 11, wherein a space exists between said plurality of short fixed length posts ends and said backing plate top surface.

13. A hybrid tile metal matrix composite armor as in claim 12, wherein said space is filled with a reinforcing material.

14. A hybrid tile metal matrix composite armor as in claim 6, wherein said plurality of post structures are a fixed length.

15. A hybrid tile metal matrix composite armor as in claim 6, wherein the space between said plurality of post structures extending outward from said encapsulating layer are filled with a reinforcing material.

16. A hybrid tile metal matrix composite armor as in claim 6, wherein said plurality of post structures have a surface area density from about 2% to about 40% of the surface area of said hybrid tile metal matrix composite armor.

17. A hybrid tile metal matrix composite armor as in claim 1, wherein said metal matrix composite armor further includes a backing plate, said backing plate spaced away from said encapsulating layer.

18. An integrated layered armor as in claim 17, wherein said spaced away backing plate is substantially parallel to said containment layer.

19. A hybrid tile metal matrix composite armor as in claim 1, wherein said reinforcing material of said at least one reinforcement insert is a dense material having from zero to a fraction of void volume at said dense material surface and no interconnected void volume within said dense material interior that is connected to said dense material surface, said dense material void volume infiltrated with metal.

20. A hybrid tile metal matrix composite armor as in claim 19, wherein said dense material has a thickness from about 0.02 inches to about 2 inches.

21. A hybrid tile metal matrix composite armor as in claim 19, wherein said dense material comprises a ceramic material selected from the group consisting of aluminum oxide, silicon carbide, boron carbide, silicon nitride and chemical vapor deposit diamond.

22. An integrated layered armor as in claim 19, wherein said dense material comprises a metal material selected from the group consisting of titanium, tungsten, molybdenum, and depleted uranium.

23. A hybrid tile metal matrix composite armor as in claim 1, wherein said inner seam thickness is from about 0.01 inches to about 0.5 inches.

24. A hybrid tile metal matrix composite armor as in claim 23, wherein said outer seam thickness is at least one half of said inner seam thickness.

25. A hybrid tile metal matrix composite armor as in claim 1, wherein said at least one reinforcement inserts have equivalent surface areas.

26. A hybrid tile metal matrix composite armor as in claim 1, wherein said at least one reinforcement insert is at least 0.005 inches thick.

27. A hybrid tile metal matrix composite armor as in claim 1, wherein said at least one reinforcement insert is at least from about 0.25 inch by 0.25 inch up to the size of said at least one material layer.

28. A hybrid tile metal matrix composite armor as in claim 1, wherein said hybrid tiles are mounted adjacent to each other.

29. A hybrid tile metal matrix composite armor as in claim 28, wherein said adjacently mounted hybrid tiles are spaced 0 to 0.01 inches apart for optimum ballistic deterrence.

30. A hybrid tile metal matrix composite armor as in claim 1, wherein said metal infiltrant is selected from the group consisting of aluminum alloys, copper, titanium, magnesium, and ferrous alloys.

31. A hybrid tile metal matrix composite armor as in claim 1, wherein said at least one reinforcement insert comprises a reinforcement material selected from the group consisting of ceramic, glass, or glass-ceramic, including oxides and non-oxide ceramics, graphite and carbon formed materials.

32. An integrated layered armor as in claim 1, wherein said at least one first reinforcement insert comprises a hollow microsphere filler material.

33. An integrated layered armor as in claim 32, wherein said hollow microsphere filler material comprises a plurality of lightweight, inert, hollow spheres filled with air, said spheres being hermetic and strong enough to withstand the pressures and temperatures of metal infiltration casting.

34. An integrated layered armor as in claim 1, wherein said at least one first reinforcement insert comprises a 3-D wire mesh.

35. An integrated layered armor as in claim 34, wherein said 3-D wire mesh is bonded to a backing plate.

36. An integrated layered armor as in claim 35, wherein said 3-D wire mesh is fusion bonded or sintered or woven to join the material layers.

37. An integrated layered armor as in claim 1, wherein said at least one first reinforcement insert comprises a plurality of hard angular faceted particles.

38. An integrated layered armor as in claim 37, wherein said hard angular faceted particles are 0.001 to 1 inch in diameter.

39. An integrated layered armor as in claim 38, wherein said particles are selected from the group consisting of Silicon Carbide, Boron Carbide and Aluminum Oxide.

40. An integrated layered armor as in claim 37, wherein said at least one first reinforcement insert comprising hard angular faceted particles is positioned as the outermost layer of said at least one material layer.

41. An integrated layered armor as in claim 1, wherein said at least one material layer comprises a top layer, a bottom layer and a middle layer, said top layer including a top reinforcement insert, said bottom layer including a bottom reinforcement insert, and said middle layer including a middle reinforcement insert, said top, bottom and middle layer further comprising a metal therein.

42. A hybrid tile metal matrix composite armor, formed by placing at least one material layer in a closed mold cavity, the outer periphery of the at least one material layer and the mold cavity inside periphery having a space defining an outer seam, comprising:

at least one material layer, said at least one material layer comprising at least one first reinforcement insert arranged along a common surface, said at least one first reinforcement insert comprising a reinforcing material having a fraction of void volume, said first reinforcement insert having at least one inner seam between a plurality of said at least one first reinforcement inserts;

said at least one material layer further comprising an outer seam, said at least one inner seam between said plurality of said at least one first reinforcement insert and said outer seam further comprising a second reinforcement insert positioned therein, said second reinforcement insert having a fraction of void volume, said void volume of said first and second reinforcement inserts further comprising a metal infiltrated within said void volume, said metal infiltration forming an encapsulating layer within said second reinforcing material positioned in said outer seam.

* * * * *